United States Patent [19]

Kondo et al.

[11] Patent Number: 4,834,796

[45] Date of Patent: May 30, 1989

[54] ELECTROLESS COPPER PLATING SOLUTION AND PROCESS FOR ELECTROLESSLY PLATING COPPER

[75] Inventors: Koji Kondo, Chiryu; Katuhiko Murakawa, Obu; Kaoru Nomoto, Okazaki; Futoshi Ishikawa, Nagoya; Nobumasa Isida, Chiryu; Junji Isikawa, Nagoya, all of Japan

[73] Assignee: Nippondenso Co., Ltd., Kariya, Japan

[21] Appl. No.: 117,079

[22] Filed: Nov. 5, 1987

[30] Foreign Application Priority Data

Nov. 6, 1986 [JP] Japan ..... 61-262619
Dec. 26, 1986 [JP] Japan ..... 61-308779

[51] Int. Cl.[4] ..... B05B 5/12; C23C 16/00

[52] U.S. Cl. ..... 106/1.23; 106/1.26; 427/305

[58] Field of Search ..... 106/1.23; 427/305

[56] References Cited

U.S. PATENT DOCUMENTS 4,265,943 5/1981 Goldstein et al. ..... 427/305
4,301,196 11/1981 McCormack et al. ..... 427/305
4,448,804 5/1984 Amelio et al. ..... 427/304
4,650,691 3/1987 Kinoshita et al. ..... 427/8
4,684,545 8/1987 Fey et al. ..... 106/1.23

FOREIGN PATENT DOCUMENTS

A164580 12/1985 European Pat. Off. .
59-25965 2/1984 Japan .
60-70183 4/1985 Japan .
60-245783 12/1985 Japan .

OTHER PUBLICATIONS

Francis J. Nuzzi, "Accelerating the Rate of Electroless Copper Plating" (Plating and Surface Finishing, Jan. 1983).

*Primary Examiner*—Theodore Morris
*Attorney, Agent, or Firm*—Cushman, Darby & Cushman

[57] ABSTRACT

A practically fast electroless copper deposition is obtained by using a trialkanolmonoamine as a complexing agent for copper ion and as an accelerator, by adding it in an excess amount of 1.2 to 30 times the mole concentration of the copper ion. An optimum increased deposition rate of 100 μm/hr is obtained even if additives such as potassium ferrocyanide, 2,2'-bipyridyl, polyethylene-grycol and an anionic surfactant are added.

12 Claims, 11 Drawing Sheets

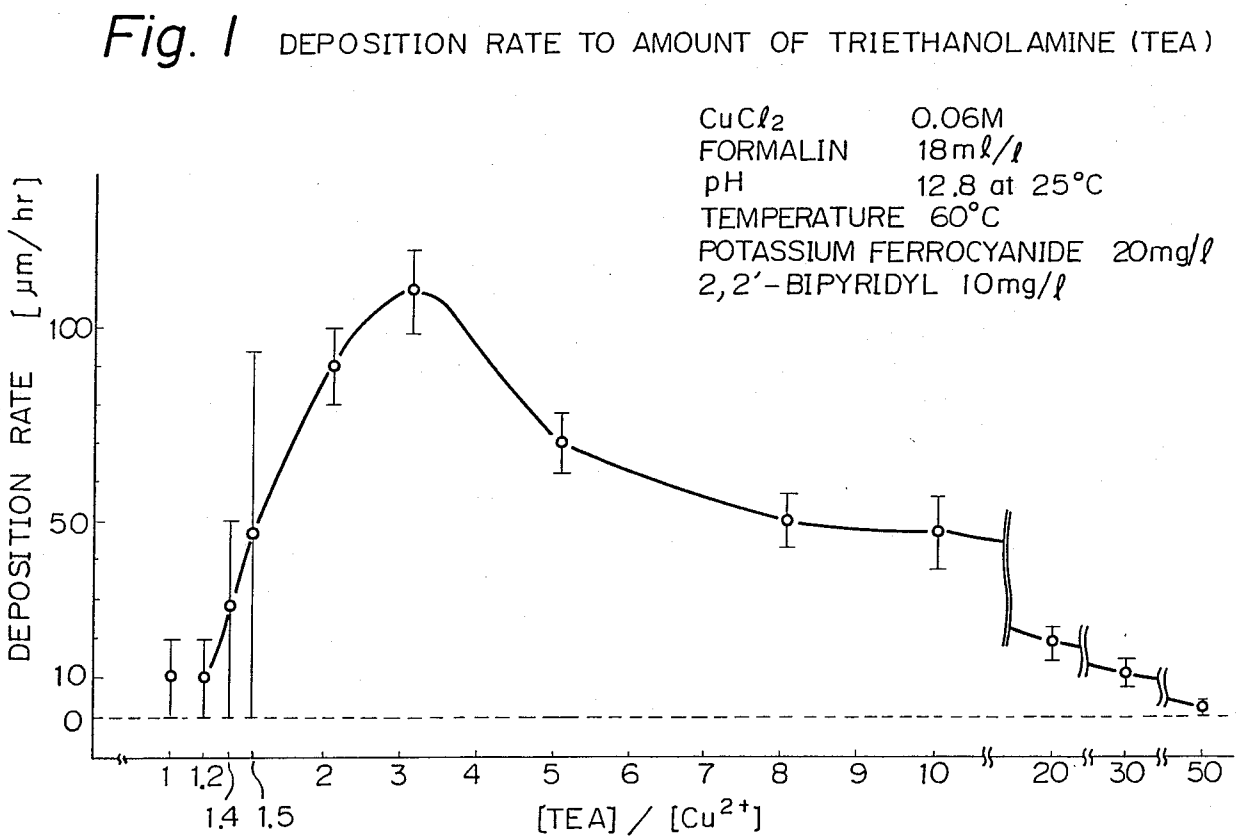
Fig. 1 DEPOSITION RATE TO AMOUNT OF TRIETHANOLAMINE (TEA)
CuCℓ2 0.06M
FORMALIN 18mℓ/ℓ
pH 12.8 at 25°C
TEMPERATURE 60°C
POTASSIUM FERROCYANIDE 20mg/ℓ
2,2'-BIPYRIDYL 10mg/ℓ
DEPOSITION RATE [μm/hr]
100
50
10
0
1 1.2 1.4 1.5 2 3 4 5 6 7 8 9 10 20 30 50
[TEA] / [Cu2+]

Fig. 2 DEPOSITION RATE TO AMOUNT OF TRIISOPROPANOLAMINE (TIPA)
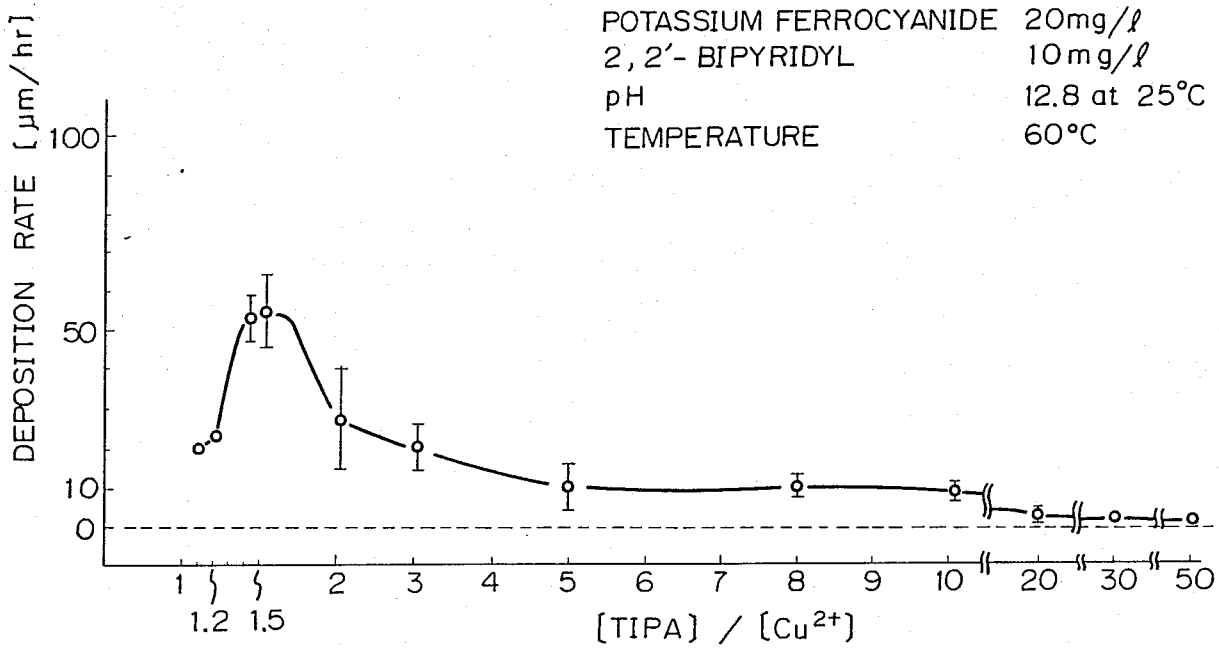

*Fig. 3* DEPOSITION RATE TO OTHER COMPLEXING AGENT
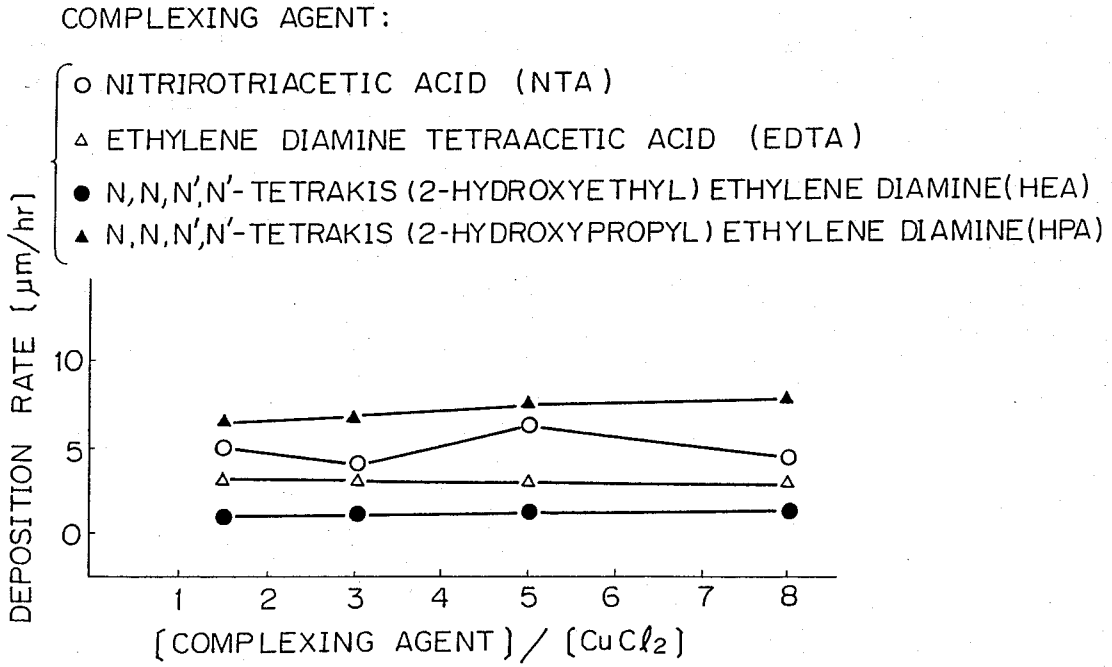

Fig. 4 REDUCTION OF DEPOSITION RATE BY MAIN ADDITIVES IN TEA BATH
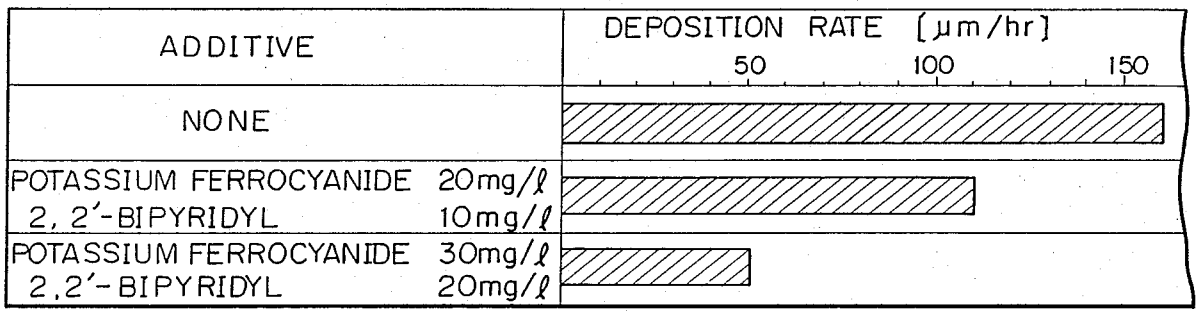
Fig. 5 REDUCTION OF DEPOSITION RATE BY MAIN ADDITIVES IN TIPA BATH
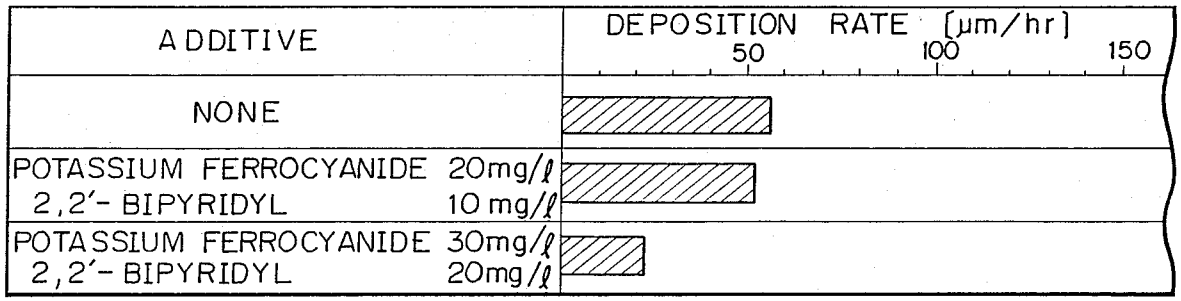

Fig. 6 DEPOSITION RATE TO pH
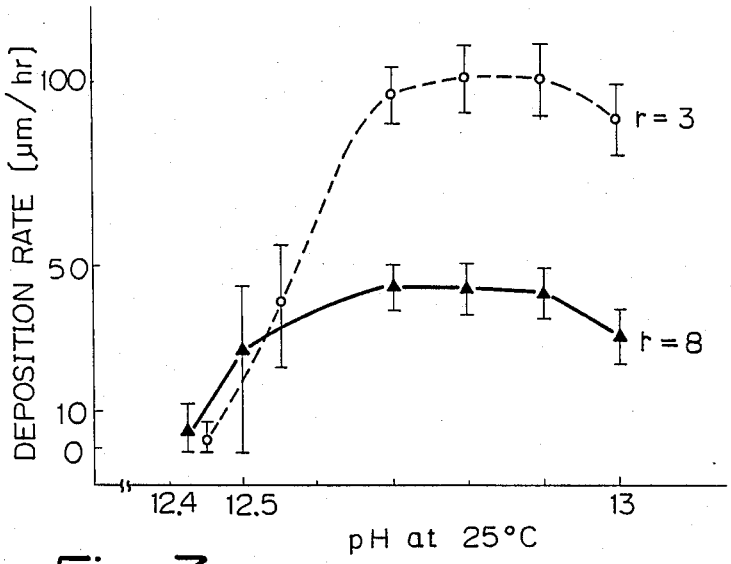
Fig. 7 DEPOSITION RATE TO $Cu^{2+}$ CONCENTRATION
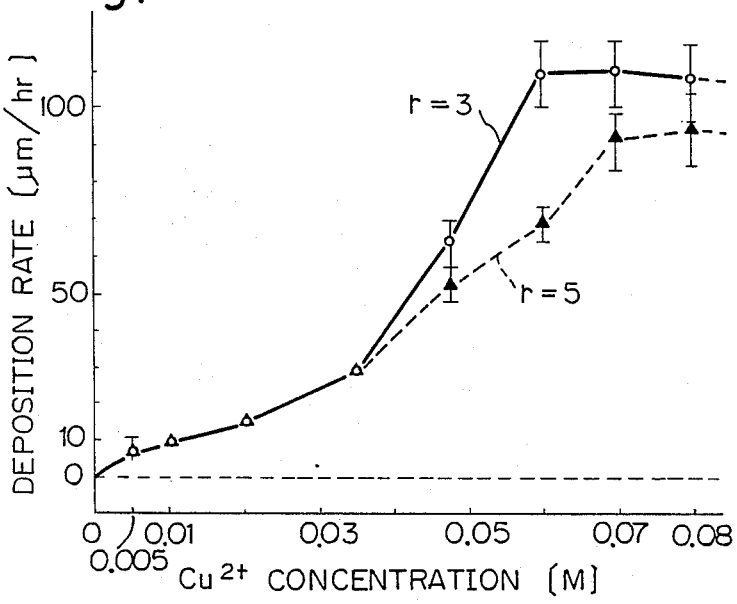

Fig. 8 DEPOSITION RATE TO FORMALIN CONCENTRATION
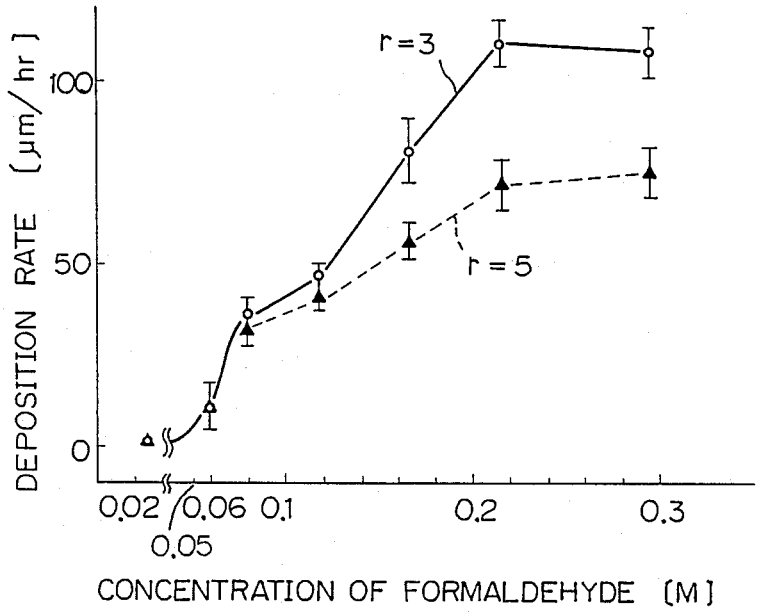

Fig. 11 DEPOSITION RATE TO $O_2$ CONCENTRATION
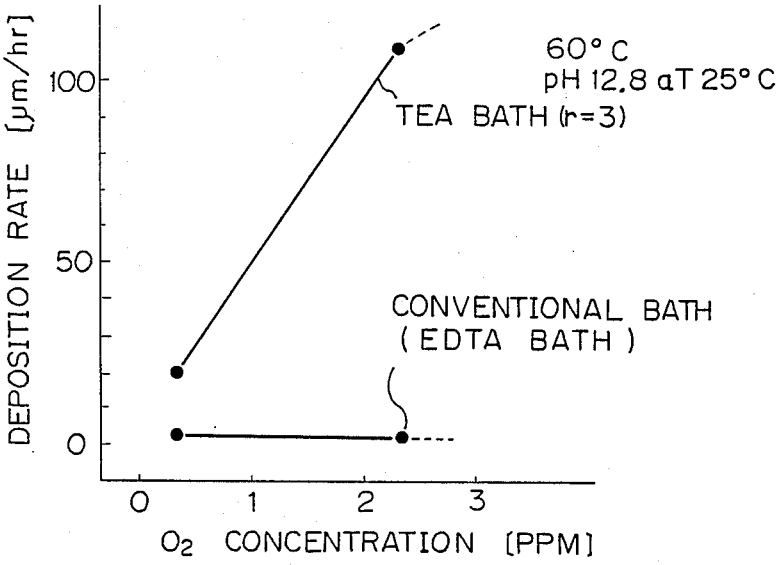
Fig. 13
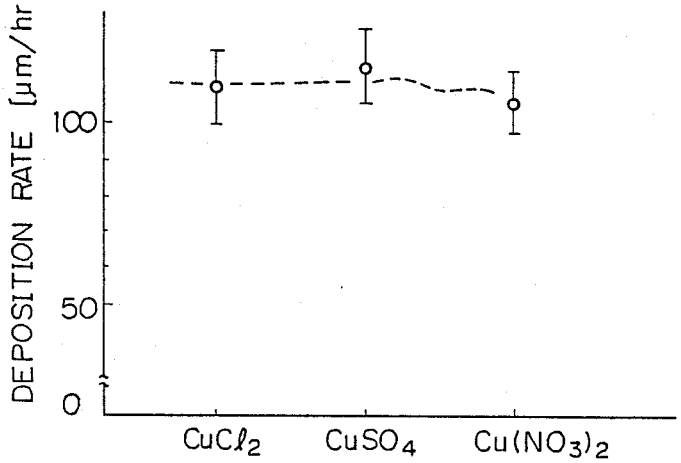

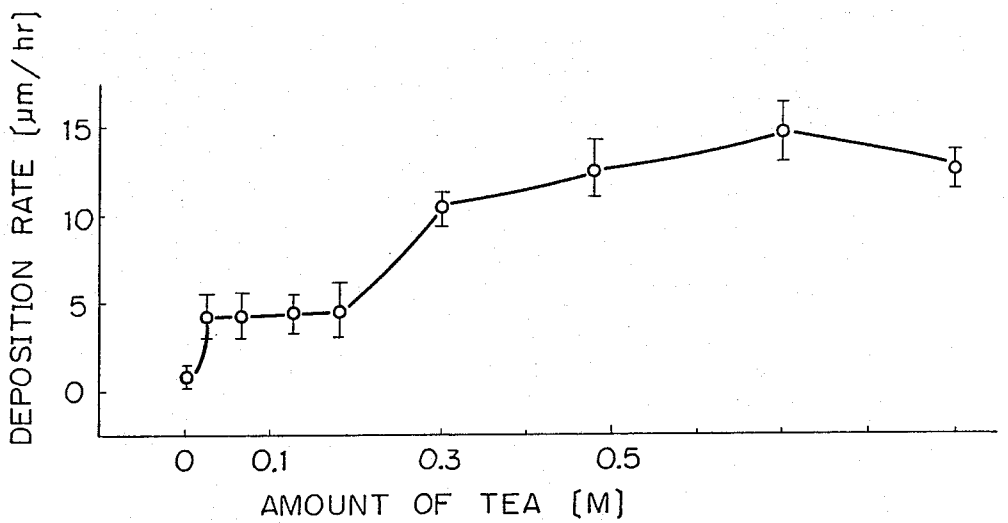
Fig. 12 EFFECT OF TEA ADDITION INTO EDTA-$Cu^{2+}$ COMPLEX BATH

Fig. 14 DEPOSITION RATE TO TEMPERATURE
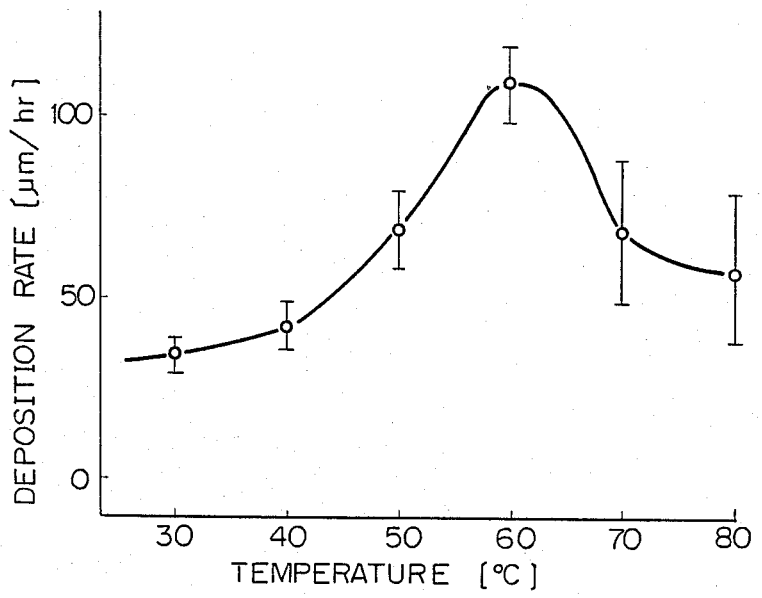
Fig. 15 TRIALKANOL MONOAMINE
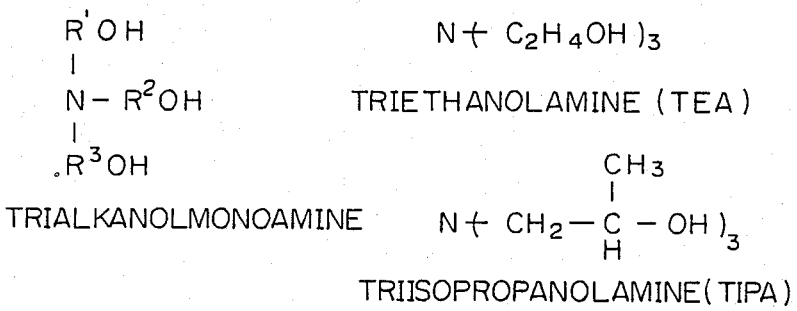

Fig. 16 VARIOUS COMPLEXING AGENTS
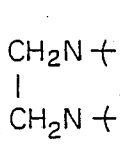
ETHYLENDIAMINE TETRACETIC ACID
(EDTA)
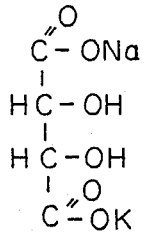
ROCHELLE SALT
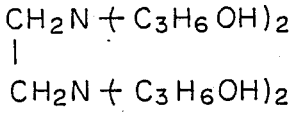
N,N,N',N'-TETRAKIS (2-HYDROXYPROPYL)
ETHYLENE DIAMINE (HPA)
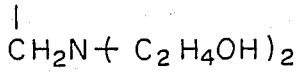
N,N,N',N'-TETRAKIS (2-HYDROXYETHYL)
ETHYLENEDIAMINE (HEA)
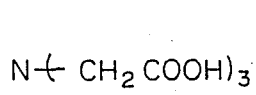
NITRINOTRIACETIC ACID (NTA)

ELECTROLESS COPPER PLATING SOLUTION AND PROCESS FOR ELECTROLESSLY PLATING COPPER

BACKGROUND OF THE INVENTION

1. Field of the Invention

The present invention relates to an electroless copper plating solution and a process for electrolessly plating copper. More specifically, the present invention relates to electroless copper plating solution and process for forming a copper plating layer used as a conductor of a printed-circuit board or a ceramic substrate, a shielding material for electromagnetic waves, or the like.

2. Description of the Related Art

Electroless or chemical copper plating baths using ethylenediaminetetraacetic acid (EDTA) or Rochelle salt (i.e. potassium sodium tartrate) as a complexing or chelating agent for copper ion are well known. Particularly such baths using copper sulfate as a copper salt and formaldehyde as a reducing agent are widely used. These electroless copper plating solutions are, however, disadvantageous because of low deposition rates, etc. Recently, to reduce the cost of, for example, printed boards, a demand has arisen for electroless plating solutions having a faster deposition rate. To meet demand, electroless plating baths using an accelerator or an activating agent with a reducing agent have been proposed, but these baths have proved unsatisfactory and it has become necessary for even faster plating baths to be developed.

Japanese Unexamined Patent Publication (Kokai) No. 60-70183 corresponding to U.S. Pat. No. 4,650,691 discloses an electroless copper plating process stabilized by adding a metal cyano complex as a stabilizer and a complexing agent for the metal of the metal cyano complex in an electroless copper plating bath, wherein an alkanolamine is used as the complexing agent for the metal of the metal cyano complex. However, in this process, another complexing agent for copper ion is included in the bath and the function of the alkanolamine as an accelerator is not effected.

Japanese Unexamined Patent Publication (Kokai) No. 59-143058 discloses an electroless copper plating solution containing triethanolamine, which provides a high plating efficiency even if the solution is prepared with inexpensive chemicals. However, a separate complexing agent for copper ion is included in this solution, further the description does not state that triethanolamine acts as an accelerator, but states that an addition of triethanolamine in an amount of more than 0.01–0.5 g/l causes decomposition of the plating solution and reduces the plating efficiency.

Japanese Unexamined Patent Publication (Kokai) Nos. 60-218479 and 60-218480 discloses an electroless copper plating solution giving a copper plating layer having excellent properties, in which an alkali-soluble inorganic silicon compound and an inorganic or organic compound for stabilizing the plating bath are included. These publications also disclose that, as a complexing agent for copper ion, chemicals having a structure with a >N—C—C—N< skeleton are preferable, and the use of triethanolamine causes problems.

Trialkanolamines are mentioned in several publications as examples of the complexing agent for copper ion in an electroless copper plating solution (for example, U.S. Pat. No. 4,301,196, Japanese Unexamined Patent Publication (Kokai) Nos. 59-25965 and 60-245783 the latter corresponding EP-164580). However, these publications disclose only that a trialkanolamine can be generally used as a complexing agent for copper ion, and do not teach or suggest the effectiveness of the trialkanolamine used in an excess amount as not only a complexing agent but also an accelerator, and further, do not disclose any experimental data in which a trialkanolamine is actually used as a complexing agent for copper ion in a plating bath.

"Electroless Plating and Plating of Plastics" (Plating Technology Materials (2), Japan, 1973) includes description of a little-known Russian academic report of an experiment wherein trialkanolamine was used as a complexing agent for copper ion in an electroless copper plating bath. However, a deposition rate of only about 1.5 μm/hr was reported in that paper.

SUMMARY OF THE INVENTION

Therefore, to solve the above-described problems, the present invention provides an electroless copper plating solution containing a copper salt, a complexing agent for copper ion, a reducing agent, and a pH-adjuster, in which an excess amount of trialkanolamine is added as the complexing agent for copper ion and as an accelerator.

BRIEF DESCRIPTION OF THE DRAWINGS

FIG. 1 shows the deposition rate in relation to the amount added of triethanolamine;

FIG. 2 shows the deposition rate in relation to the amount added of triisopropanolamine;

FIG. 3 shows the deposition rate in relation to complexing agents other than trialkanoloamine;

FIGS. 4 and 5 show the reduction of the deposition rate of a triethanolamine bath and a triisopropanolamine bath caused by the addition of main additives;

FIG. 6 shows the deposition rate in relation to the pH of a triethanolamine bath;

FIG. 7 shows the deposition rate in relation to the $Cu^{2+}$ concentration of a triethanolamine bath;

FIG. 8 shows the deposition rate ih relation to the formalin concentration of a triethanolamine bath;

FIG. 11 shows the deposition rate in relation to the $O_2$ concentration of a triethanolamine bath;

FIG. 12 shows the deposition rate when triethanolamine is added to an ethylendiaminetetraacetic acid bath;

FIG. 13 shows the deposition rate when various copper salts are used in a triethanolamine bath;

FIG. 14 shows the deposition rate in relation to the temperature of a triethanolamine bath;

FIG. 15 shows the chemical formulae of trialkanolmonoamines; and

FIG. 16 shows the chemical formulae of various complexing agents.

DESCRIPTION OF THE PREFERRED EMBODIMENTS

Figure 9:
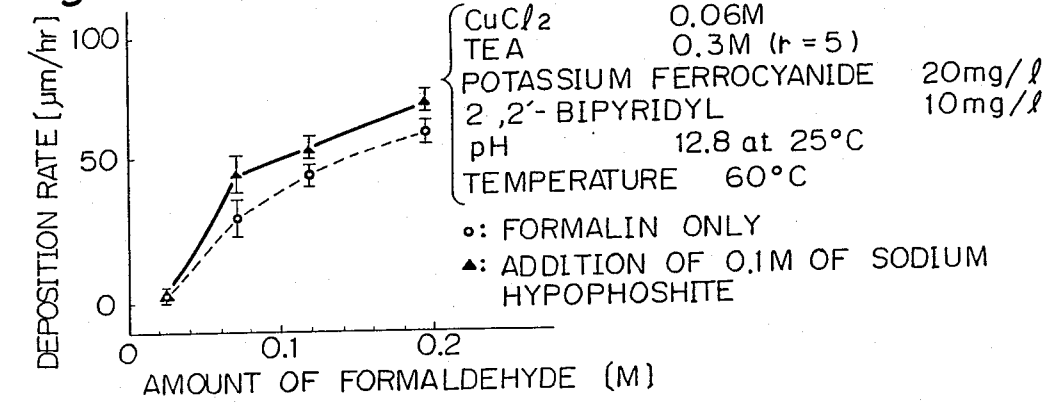
FIGS. 9 and 10 show the deposition rates when only formalin is added as a reducing agent, and a combination of formalin with sodium hipophosphite is added, to triethanolamine and triisopropanolamine baths.

Conventionally, as a complexing agent for copper ion, EDTA (ethylenediaminetetraacetic acid) and Rochelle salt are used in practice in electroless copper plating solutions and N,N,N',N'-tetrakis(2-hydrxypropyl)ethylenediamine, nitrirotriacetic acid, etc. are used in research. The copper deposition rates of electroless copper plating solutions using such a complexing agent are very slow and usually are between 1 and 2 μm/hr. These reduced rates are due to the additives used to improve the physical properties of the plated layer, but even in basic plating baths, comprising only a copper salt, a complexing agent and a pH-adjustor, and without other additives, the fastest deposition rate is 10 μm/hr. Recently, a fast copper deposition rate of 72 μm/hr was obtained by a solution using N,N,N',N'-tetrakis(2-hydoxypropyl)ethylenediamine as the complexing agent, with an activator added thereto (Japanese Unexamined Patent Publication (Kokai) No. 59-25965). However, in practice, the deposition rates obtained by this plating solution were reported to be between 2 and 5 μm/hr, in Japanese Unexamined Patent Publication (Kokai) No. 60-159173.

As a result of tests using various complexing agents, the present inventors found that, by using a monoamine-type trialkanolamine, particularly triethanolamine, as the complexing agent and as an accelerator, a copper deposition rate of 100 μm/hr or more can be obtained, and even if additives for improving the properties of a deposited layer are added, very fast deposition rates of 30 to 120 μm/hr can be obtained and the properties of the deposited layer are excellent. Thus the present invention was created.

There appear to be few or no reports of the actual use of a trialkanolamine as a complexing agent for copper ion in electroless copper plating. The above-mentioned Russian academic paper reported that a deposition rate of about 1.5 μm/hr was obtained in a bath containing triethanolamine as a complexing agent for copper ion at a high pH of 13.0 (see "Electroless Plating and Plating on Plastics" ibid.). This result is contrary to the data shown by the present invention, but this discrepancy is believed go be due to the extremely narrow ranges of the conditions (particularly temperature, pH, $O_2$ concentration, etc.) prevailing during the experiments mentioned in said paper.

In the experiments carried out by the present inventors, it was found that, when triethanolamine is used in an amount of more than 1.2 times the mole concentration of the copper, an extremely fast desposition rate can be obtained. This result is contrary to the normal understanding of complexing agents, but is easily explained if it is understood that the triethanolamine also acts as an accelerator. That is, normally, a complexing agent for copper ion hinders the reducing reaction of $Cu^{2+} \rightarrow Cu^0$ during the plating since the complexing agent coordinates with the copper ion and the produced complex is made soluble to prevent a precipitation of the copper ion under an alkali condition. It is believed that, to deposit copper, the coordinate bond of the complex formed from the complexing agent and the copper ion must be broken and the copper ion separated from the ligant, and thus the complexing agent usually interfares with the deposition of the copper. Moreover, from the eqilibrium reaction of the formation of a complex ion: $Cu^{2+} + L \rightleftharpoons Cu^{2+} - L$, where L is a ligant and wherein the free ion of $Cu^{2+}$ is considered to be more reactive than the complex ion of $Cu^{2+} - L$, a plating bath is designed so that L is reduced as much as possible, to prevent a decrease in the deposition rate, while reduction of L to be insufficient causes a decomposition of the bath or a precipitation of $Cu(OH)_2$. Accordingly, a normal amount of a complexing agent is from 0.8 to 1.5 times the concentration of $Cu^+$, which is also best from the viewpoint of economy.

In their research, the present inventors ignored the conventional concept and thus found that, if a trialkanolamine is used in an excess amount such that it acts not only as a complexing agent but also as an accelerator, a faster copper deposition rate is obtained.

The inventors disclosed, in Japanese patent application Nos. 61-152620, 61-269806, and 62-154309 and Japanese patent application having a title "Chemical Copper Plating Solution" filed on Oct. 21, 1986 and, corresponding U.S. patent applications including U.S. Ser. No. 068,366, filed on July 1, 1987, that $BF_4^-$ and trialkylamine are effective accelerators, and that these chemicals are electron rich or electron donative. The inventors proceeded with their research by using the concept that is such properties are given to a complexing agent, an even faster deposition rate might be obtained and, as a result, a very fast electroless copper plating, which is unbelievable in view of the conventional knowledge of this field, was developed.

In the former disclosure by the present inventors of acceleration by a trialkylamine, only a trialkylamine, among alkylamines, is effective as an accelerator. Diamines with two amino groups do not exhibit an acceleration effect but on the contrary, exhibit a deceleration effect. The reasons for this are not clear but many factors, such as adhesion at interfaces, electron donativity, and chemical activity, must be considered.

In their research for the present invention, the inventors used the results of their previous research, and a search was made for trialkanolamines able to complex with copper ion, among trialkylamines with only one amino group. As a result, a very fast electroless copper plating reaction, which can not be explained by the electron donative ability thereof only, was obtained. Such effects were obtained by both triethalolamine and triisopropylamine, which among trialkanolamines are readily available. The deposition rates depend greatly on the concentration of the trialkanolamine. Further, a nitrirotriacetic acid is known as another chemical which has one amino group and can complex copper ion, but a fast plating reaction was not obtained therewith. This is probably because nitrirotriacetic acid has a calboxylic group (a keton group), not just a hydroxy group. Accordingly, as is clear from the above description, a very fast plating reaction can be obtained only when a trialkanolmonoamine is used as a complexing agent and as an accelerator.

FIG. 1 shows experimental results of electroless plating when triethanolamine, a typical trialkanolmonoamine, is used as a complexing agent at a mole ratio of 2 to 5 times that of the complexing agent to that of the copper ion, a particularly fast plating reaction is obtained. It should be noted that 100 μm/hr is an extraordinarily fast copper deposition rate when typical additives such as potassium ferrocyanide and 2,2'-bipyridyle were added to a bath at 60° C.

The other available trialkanolamine is triisopropanolamine, and the relationship between the deposition rate and the added amount thereof is shown in FIG. 2. In comparison with triethanolamine, a fastest deposition rate of about 50 μm/hr is obtained, which is relatively low but is still about 30 times faster than that of a conventional plating bath (a bath with EDTA as a complexing agent). A particularly fast reaction was obtained at a [a complexing agent]/[$Cu^{2+}$] ratio of 1.5 to 3, which is smaller than the corresponding ratio used in the case of triethanolamine.

In comparison, among generally used complexing agents, ethylenediaminetetraacetic acid (EDTA), N,N,N',N'-tetrakis(2-hydroxypropyl)ethylenediamine, and N,N,N',N'-tetrakis(2-hydroxyethyl)ethylenediamine having the diamine structure of triethanolamine, and nitrirotriacetic acid having one amino group but not being an alcohol, were examined under exactly the same conditions as used for the trialkanolamines. The results are shown in FIG. 3. In all cases, the deposition rates were less than 10 μm/hr and were not changed by the amount of complexing agents, which is very different from the results obtained by the trialkanolmonoamines. From these experiments, it is deemed that the trialkanolmonoamine acts not only as a complexing agent but also as an accelerator.

This is the first time that such data has been reported and the following should be particularly noted:

(1) the acceleration effect appears when the complexing agent/$Cu^{2+}$ mole ratio is larger than the conventional ratio of 0.8 to 1.2, or 1.5 or 2.0.

(2) the acceleration effect is shown by the trialkanolmonoamine structure but not by diamines with two amino groups.

(3) the acceleration effect appears only when the organic groups bonded to the amino group have a hydroxyl group, but does not appear if they have a calboxylic group or a keton group.

(4) the speed of the deposition rate is such that it would not be considered obtainable from a normal oxydation-reduction reaction.

Thus, according to the present invention, there is provided an electroless copper plating solution comprising a copper salt, a reducing agent, a pH-adjustor, and an excess amount of trialkanolmonoamine or a salt thereof such that it acts as a complexing agent for copper ion and as an accelerator, the trialkanolmonoamine or a salt thereof being present in an amount such that a substantially increased copper deposition rate is obtained, in comparison with the copper deposition rate obtained when the trialkanolmonoamine or a salt thereof is present in an amount sufficient to completely complex the copper ion but not enough to act as an accelerator.

According to the present invention, there is also provided a process for electrolessly plating copper, comprising immersing a substrate having a surface sensitive to copper deposition in an electroless copper plating bath containing a copper salt, a reducing agent, a pH-adjustor and trialkanolmonoamine or a salt thereof in an excess amount such that it acts as a complexing agent and as an accelerator, whereby copper is electrolessly deposited on the surface of the substrate at a substantially increased deposition rate, in comparison with the copper deposition rate obtained when the trialkanolemonoamine or a salt thereof is present in an amount sufficient to complex the copper ion but not enough to act as an accelerator.

The copper salt used is not particularly limited as long as a copper ion is provided, and includes copper sulfate ($CuSO_4$), copper chloride ($CuCl_2$), copper nitrate ($Cu(NO_3)_2$), copper hydroxide ($Cu(OH)_2$), copper oxide (CuO), Copper (I) chloride (CuCl), and the like. The concentration of the copper salt in the bath is generally 0.005M to 0.1M, preferably 0.01M to 0.07M. Typical change of the deposition rate to $Cu^{2+}$ concentration is shown in FIG. 7. It is seen from the figure that 0.005M or more of the $Cu^{2+}$ concentration is necessary for attaining accelerated deposition in comparison with those of conventional baths, and 0.1M or less is generally preferable due to stability and economy, although these depend on conditions of a bath.

The reducing agent used is not particularly limited as long as the copper ion is reduced to metal copper, and formaldehyde and derivatives and precursors thereof such as paraformaldehyde are most suitable. The reducing agent is generally in an amount of 0.05M or more, preferably 0.05M to 0.3M, as the amount of formaldehyde. Typical change of deposition rate to the amount of formaldehyde is shown in FIG. 8. It is seen that 0.05M or more of a concentration of the reducing agent is necessary for attaining accelerated depositon rate in comparison with those of conventional baths and 0.3 or less is preferable due to stability of bath and economy.

The pH-adjustor is not particularly limited as long as the pH of the bath is altered thereby, and includes NaOH, KOH, HCl, $H_2SO_4$, HF, and the like. The pH of the base is generally 12.0 to ;b 13.4 at 25° C., desirably 12.4 to 13.0 at 25° C. Typical change of the deposition rate to pH is shown in FIG. 6. A bath according to the present invention highly depends on pH and pH of 12.4 to 13.0 is preferable for acceleration. At more than 13 of pH, the stability become worse.

The electroless copper plating bath of the present invention may contain additives such as a stabilizer and other additives generally used, in addition to the above ingredients. The stabilizer for stabilizing the bath or various additives for improving the properties of the deposited copper layer are not particularly limited and such additives will not alter the effects of the addition of an excess amount of a trialkanolmonoamine or a salt thereof. Typical conventional additives include potassium ferrocyanide, 2,2'-bipiridyl, and neutrious surfactant such as polyethylenegrycol. We further found that an anionic surfactant is very effective to improve properties of an electroless copper plating layer. The anionic surfactant includes a metal alkylsulphonate, a metal alkylarylsulphonate, a metal salt of sulphosuccinate ester, alkyl sulfate, an alkali salt of a higher aliphatic acid, etc. These anionis surfactant may be fluorinated on siliconated. (See Japanese patent application No. 61-308779.)

In the present invention, a trialkanolmonoamine or a salt thereof (hereinafter referred to as trialkanolmonoamine) is added as a copper ion complexing agent and accelerator. To make a trialkanolmonoamine act not only as a complexing agent but also as an accelerator, the trialkanolmonoamine is preferably added in an amount of 1.2 times or more the mole of the copper ion. The preferable amount depends on the kind of trialkanolmonoamine used. In the case of triethanolamine, the deposition rate is increased by 1.2 or more times, particularly 1.3 or more times, the mole of copper ion, but at an amount of up to 1.5 times, the initial reaction is unstable, and thus more than 2 times, 3 times or 5 times of trialkanolmonoamine is preferable from the viewpoint of the reaction initiation. However, at an amount of a trialkanolmonoamine of 1.2 to 1.5 times the mole of the copper ion, although the reaction initiation is unstable the deposition rate is remarkably increased in comparison with that obtained when the mole maount is almost equal to that of the copper ion. This fact is heretofore unknown. The upper limit of a trialkanolmonoamine is generally 30 times, preferably 20 times the mole of copper ion. In the case of triisopropanolamine, at an amount of 1.2 times or more, particularly 1.5 to 3.0 times the mole of the copper ion, the deposition rate is increased. The absoute amount of a trialkanolmonoamine in a bath thus ranges generally from 0.006M to 2.4M, particularly from 0.012M to 1.6M. This is concluded from the change of the deposition rate to $Cu^{2+}$ concentration (FIG. 7) and to the amount of TEA (FIG. 1) and it may be said that in such an amount of trialkanolmonoamine, acceleration does not depend on concentrations of other ingredients. It is not necessary for only one kind of trialkanolmonoamine to be used, and a mixture of trialkanolmonoamines, such as a mixture of triethanolamine and triisopropanolamine, may be used.

The trialkanolmonoamine used in the present invention is represented by the following formula:

$$\begin{array}{c} R^1OH \\ N-R^2OH \\ R^3OH \end{array}$$

where $R^1$, $R^2$ and $R^3$ are independently an alkylene group, a saturated hydrocarbon group which may include oxygen or a phenylene group in the skeleton thereof, or a halogen- or hydroxy-group-substituted derivative of the former.

Examples of a trialkanolmonoamine include triethanolamine, triisopropanolamine, trimethanolamine, tripropanolamine, etc.

The salt of a trialkanolmonoamine includes triethanolamine chloride, triethanolamine phosphate, etc.

The copper deposition rates obtainable by the present invention are more than 10 times, particularly 50 times, the deposition rates obtained when the trialkanolmonoamine or a salt thereof is used only as a complexing agent for copper ion and not as an accelerator, although heretofore it has not been practically used in electroless copper plating baths. This improvement of the deposition rate appears irrespective of addition of any additives such as potassium ferrocyanide and 2,2'-bipyridyl for improving the properties of a deposited copper layer. Thus, the copper deposition rates obtainable are more than 100 μm/hr, particularly 160 μm/hr, in basic baths without additives as mentioned above, and more than 30 μm/hr, particularly 120 μm/hr, in baths with the additives. These deposition rates are more than 3 times, particularly 12 times, the deposition rate (10 μm/hr) attainable by baths using N,N,N',N'-tetrakis(2-hydroxypropyl)ethylenediamine, which are typical fast plating baths.

The procedures of plating with a bath of the present invention or theprocess of plating of the present invention may be conventional. Generally, an article or substrate to be treated, for example, made of glass epoxy or paper phenol, is pretreated (cleaned and chemically roughened) and catalyzed (normally deposited with palladium) to make the substrate sensitive to copper deposition before the substrate is immersed in a chemical plating bath to deposit copper on the surface of the substrate.

The temperature of the bath of the present invention is preferably from a a room temperature (0° C. to 25° C.) to 80° C., particularly from a room temperature to 70° C. Typical relationship between the bath temperature and the deposition rate is shown in FIG. 14. Even at room temperature (less than 30° C.), sufficient fast deposition is possible, but the stability of the bath become worse at more than 80° C.

The copper deposition rate greatly depends on the oxygen concentration in the bath and the solved oxygen concentration must be from 0.5 to 5.4 ppm, preferably from 1.5 to 4.0 ppm. Typical relationship of the deposition rate to the $O_2$ concentration is shown in FIG. 11. At a lower $O_2$ concentration, the deposition rate and the stability are decreased and hence 0.5 ppm or more, preferably 1.5 ppm or more of the $O_2$ concentration is necessary. The upper limit of the $O_2$ concentration is due to economy concerning an $O_2$ bomb.

The present invention is further described below by Examples.

(1) Nature of triethanolamine

The stability constants of complex ions of main complexing agents with $Cu^{2+}$ are shown in Table 1.

TABLE 1

| Stability Constant of Complex Ion | |
|---|---|
| Complexing agent | Stability constant |
| Rochelle salt | 15.0 |
| EDTA | 18.8 |
| TEA | 20.7 |
| NTA | 12.96 |

*EDTA: Ethylenediaminetetraacetic acid
**TEA: Triethanolamine
***NTA: Nitrirotriacetic acid Since the stability constant is represented by a logarithm of the equilibrium constant of $Cu^{2+}+L \rightleftarrows Cu^{2+}-L$ (L is a ligant), the complex ion $Cu^{2+}-L$ is more stable because it has a larger stability constant value. For example, the stability constant value of triethanolamine is larger than that of EDTA by about 2, but a complex of triethanolamine$-Cu^{2+}$ is considerably more stable than a conventionally used complex of EDTA$-Cu^{2+}$ because the stability constant is represented by a logarithm. Although usually there is no relationship between the stability constant and the deposition rate, the larger the stability constant, the more difficult the reaction initiation. The triethanolamine is a typical example of a case where it is difficult to initiate the reaction when the activity of the catalyst is low. In the deposition rates of triethanolamine/$Cu^{2+}$ shown in FIG. 1, it is difficult to obtain the reaction if $r=[TEA]/[Cu^{2+}]=1.2$ or less. If r=near 1.5, the deposition rate is fast and 100 μm/hr or more if the reaction is initiated, but sometimes the reaction can not be initiated.

The initiation of the reaction depends on various conditions of the bath, but it was found after investigation that it depends greatly on the conditions of the surface of the substrate to be plated, i.e., catalyst activity, surface states, etc.

For example, a stainless steel plate is normally plated by an EDTA bath but is not plated by a triethanolamine bath. A stainless steel plate with a palladium catalyst has an activity with dispersion and depends on a catalizing solution used. However, on a glass epoxy substrate when was etched and then provided with palladium by a catalyst solution, a good reaction occurs even in a triethanolamine bath. These results are shown in Table 2. The triethanolamine bath used is shown below.

| | |
|---|---|
| CuCl | 0.06 M |
| Formalin* | 18 ml/l |
| TEA | 0.18 M |

-continued

| | |
|---|---|
| Potassium ferrocyanide | 20 mg/l |
| 2,2'-bipyridyl | 10 mg/l |
| pH at 25° C. | 12.8 |
| Bath temperature | 60° C. |

Note
Formalin* is a 37% aqueous solution of formaldehyde.

TABLE 2

Experimental reactivity of triethanolamine with substrates

| Substrate (Catalyst) | Reactivity (Initiated or not) | |
|---|---|---|
| Stainless steel plate | x | Little reaction |
| Stainless steel plate + Pd catalization | Δ | Depends on catalyst solutions |
| Glass epoxy plate + Pd catalization | ◎ | Very good reaction |
| Stainless steel plate + copper film | o | Substantial reaction |

The used plating solution is a solution which exhibits the fastest deposition rate in FIG. 1. In all of the following experiments, to uniformalize the conditions for obtaining data, a stainless steel plate was treated with a Pd catalizing solution followed by copper plating in an EDTA bath shown in Table 3 at 50° C. to cover the entire surface of the plate with a thin (0.2 to 0.3 μm) copper film and the thus obtained test pieces were used. Thus, the factors of the surface states were made uniform or constant.

if a glass epoxy substrate (for a printed board) formed with an ABS adhesive, is chemically roughened and then activated by a Pd catalizing solution, the thus obtained test pieces are very reactive, but if the chemical roughenness is not uniform, the reaction rate may be affected or altered. Therefore, the catalystic activity is made uniform by using a stainless steel plate activated with a Pd catalyzing solution followed by electrolessly plating in a basic EDTA bath to form a copper film having a thickness of 0.2 μm. If a stainless steel plate with a Pd catalyzing treatment but without a copper plating treatment is used, sometimes plating does not occur in the main bath or a relatively slow reaction speed is obtained. Therefore, care is necessary in this process.

(2) Method used in experiments

A stainless steel plate 3 cm×7 cm and having an area of 40 $cm^2$ was cleaned and treated with a Pd catalyzing solution, for example, Catpo-44-C (sold by Shipley Co.). Then, the plate was activated with an accelerator ACC-19-C (sold by Shipley Co.). The thus pretreated stainless steel plate was plated in an EDTA bath shown in Table 3 for 2 minutes, to form a copper film having a thickness of 0.1 to 0.2 μm. After washing with water, the plate was subjected to electroless plating in a plating solution to be tested (500 cc) for 10 minutes. Then, the deposited film thickness was measured by an electrolysis-type film thickness measuring machine, and the measured thickness was converted to the deposition rate per 1 hour. The plating load was 80 $cm^2/l$ and the pH-adjustor was NaOH.

The plating bath was continually air-stirred by blowing air therein and was not stirred mechanically in any way. The air stirring brought the oxygen concentration in the bath to 1.5 to 4.0 ppm. The current baths are easily affected by the oxygen concentration, and thus air bubbling must be carried out.

TABLE 3

Plating bath for forming Cu film on the substrate before taking data

| | |
|---|---|
| $CuCl_2$ | 0.06 M |
| EDTA | 0.08 M |
| Formalin | 18 ml/l |
| pH | 12.5 at 25° C. |
| Bath temperature | 50° C. |

(3) Reduction of deposition rate by additives

Normally, two kinds of main additives are used for an electroless copper plating bath, e.e., a stabilizer for the bath and a modifier for a plated layer. Many chemicals are known to be used as such additives. In the present experiments, potassium ferrocyanide and 2,2'-bipyridyl, which are thought to markedly reduce the copper deposition rate, were used at two levels of addition. The results are shown in FIGS. 4 and 5. FIG. 4 shows the results from the following bath (I), in which triethanolamine (TEA) is used as the complexing agent and accelerator in an amount of three times the mole of copper ion, and FIG. 5 shows the results from the following bath (II), in which triisopropanolamine is used as the complexing agent and accelerator in an amount of 1.5 times the mole of copper ion.

| | |
|---|---|
| Bath (I): | |
| $CuCl_2$ | 0.06 M |
| TEA | 0.18 M |
| | ([TEA]/[$Cu^{2-}$] = 3) |
| Formalin | 18 ml/l |
| pH | 12.8 at 25° C. |
| Bath temperature | 60° C. |
| Bath (II): | |
| $CuCl_2$ | 0.06 M |
| TIPA | 0.09 M |
| | ([TIPA]/[$Cu^{2-}$] = 1.5) |
| Formalin | 18 ml/l |
| pH | 12.8 at 25° C. |
| Bath temperature | 60° C. |

In both cases, the depositon rate is decreased by an increase of additives. However, even when potassium ferrocyanide is added in 30 mg/l and 2,2'-bipyridyl in 20 mg/l, the triethanolamine bath exhibits 50 μm/hr and the triisopropanolamine bath 20 μm/hr, both of which are fast deposition rates. From comparison between these two baths, the triethanolamine bath shows a deposition rate approximately twice as fast as the triisopropanolamine bath, and therefore, the triethanolamine bath was the main subject of the following experiments. If additives are not used, in a triethanolamine bath, the deposition rate is too fast and a rigid layer is not obtained, and thus the deposition may become powdery. To avoid this, potassium ferrocyanide at 20 mg/l and 2,2'-bipyridyl at 10 mg/l were added as additives in all of the following experiments, including the comparative experiments or examples. This, however, does not relates to the stability of the bath, and the triethanolamine bath is always stable even in an additive is not added, as supposed from the stability constant of the triethanolamine.

(4) Change of deposition rate by amount of added trialkanolmonoamine

These are the main results of the experiments of the present invention. Among the trialkanolmonoamines, triethanolamine and triisopropanolamine were selectd and the respective results are shown in FIGS. 1 and 2, respectively. In both cases, the following basic bath was used.

| | |
|---|---|
| $CuCl_2$ | 0.06 M |
| Formalin | 18 ml/l |
| Potassium ferrocyanide | 20 mg/l |
| 2,2'-bipyridyl | 10 mg/l |
| pH at 25° C. | 12.8 |
| Bath temperature | 60° C. |

As shown in FIG. 1, triethanolamine usually forms a complex with copper ion, on a one to one basis. Accordingly, in conventional complexing agent, triethanolamine is used in a range of 0.8 to 1.5 or r=[TEA]/-[$Cu^{2+}$]. When r=1 to 1.2, it was relatively difficult to obtain the reaction which is natural considering the stability of a complex of triethanolamine—$Cu^{2+}$, but when the reaction was obtained, it resulted in a deposition rate of 10 to 20 μm/hr. However, if experiments are conducted when r=1 to 1.2, little reaction occurs and the substrate forms a passivation film, and thus it is normally concluded that triethanolamine cannot be used as a complexing agent.

When r=1.2 to 1.5, the reaction was easier to obtain, and was obtained in most cases if the test pieces of a glass epoxy substrate were chemically etched and then Pd catalyzed. However, with a test piece of a stainless steel plate with a copper film, the reaction was obtained in only one out of five cases, although if the reaction was obtained, fast deposition rates of 50 to 100 μm/hr resulted.

When the triethanolamine is added at an excess amount of r=2 or more, the reaction was obtained in every case, and a fast deposition rate of 100 μm/hr or more was obtained as shown in FIG. 1. The deposited layer was reddish brown and had no luster.

In a bath with a further excess amount of triethanolamine of r=5 or more, the deposition rate tended to be slightly decreased. These are considered due to a disturbance of mass transfer by an increase of the viscosity of the solution. Nevertheless, the initiation of the reaction was always obtained. In all cases, the bath was completely stable and an undesirable deposition and decomposition of the bath were not observed. These are expected from the stability constant of the triethanolamine and are one of characteristics of a triethanolamine both.

Although the stability constant of triisopropanolamine is not known but the reaction is always obtained, the triisopropanolamine complex is considered to be less stable than the triethanolamine complex. The stability of the bath also seemed to be lower in the case of triisopropanolamine than triethanolamine. When an expression of [TIPA]/$Cu^{2+}$]=r is used, high deposition rates of about 20 μm/hr appeared at r=1.2 or more and the fastest deposition rate of about 50 μm/hr was seen at r=about 1.5. The deposition rate decreased from r=about 2 and became constant at 20 to 10 μm/hr. All deposited layers were a lustrous skin-color. Comparing triethanolamine and triisopropanolamine, the effects are very similar while the degree of the effects is different. This similarity is a characteristic of the trialkanolmonoamine. Similar results were obtained when salts of trialkanolmonoamine were used, for example, triethanolamine hydrochlorate.

For comparison, similar experiments were carried out with other complexing agents. The results are shown in FIG. 3. The used complexing agents were ethylenediaminetetraacetic acid (EDTA), which is most commonly used; nitrirotriacetic acid, which is a monoamine type of EDTA; N,N,N',N'-tetrakis(2-hydroxyethyl)ethylenediamine (HEA), which is a diamine structure of triethanolamine; N,N,N',N'-tetrakis(2-hydroxypropyl-)ethylenediamine (HPA), which is a diamine structure of triisopropanolamine. The basic bath for these complexing agents was the same as that used in the cases of triethanolamine and triisopropanolamine.

From FIG. 3, it is clear that if any complexing agents other than a trialkanolmonoamine are used, the accelerating effect obtained by the increase of r=[Complexing agent]/[$Cu^{2+}$] does not appear and only deposition rates of less than 10 μm/hr resulted. It should be noted that nitrirotriacetic acid, a monoamine type complexing agent having a calboxylic group not a hydroxyl group, and HEA and HPA, diamine-type amine with a hydroxyl group, have no accelerating effect at all. This conforms to that of the acceleration effect of trailkylamines. From these results, the desirable amount of the trialkanolamine is 1.2 to 30 times the amount of the copper ion by mole, which obtainable from the consideration of obtaining a faster deposition rate than conventional rates, i.e., more than 10 μm/hr. More desirably, the amount is 1.3 to 20 times. The upper limit of the amount should be considered from the viewpoint of economy. The trialkanolmonoamine present in excess to complex the copper ion probably helped to initiate the reaction or acts as an accelerator and, as a result, an accelerated plating reaction was obtained.

(5) Change of deposition rate by pH of triethanolamine bath

FIG. 6 shows the results of changes of the deposition rates by the pH of the trietanolamine bath, which has the highest accelerating effect. The pH was measured at 25° C.

The experiments were conducted at [TEA]/-[$Cu^{2+}$]=r=3 and 8. In both cases, high accelerating effects are found at a pH of 12.6 to 12.9. This high pH is considered to be necessary in order to further activate the formalin of a reducing agent, because the TEA—-$Cu^{2+}$ complex is stable. From FIG. 6, the pH of the bath, although it depends on the bath conditions, is suitably 12.0 or more, particularly 12.4 to 13.

(6) Change of deposition rate by $Cu^{2+}$ concentration in TEA bath

FIG. 7 shows the changes of the deposition rate when [TEA]/[$Cu_{2+}$]=r=3 and 5 and the amount of a copper salt was changed. It is seen that the deposition rate depends consierably on the copper concentration.

The characteristic is that the reaction was relatively fast even if the copper concentration was considerably reduced. Although a 0.04M to 0.07M $Cu^{2+}$ concentration is conventionally used, a 0.005M concentration, about one tenth of the conventional concentrations, gave a considerably fast deposition rate of 7.2 μm/hr. Here, if 10 μm/hr is considered to be a limit of fast plating, the absolute amount of TEA should be 0.005M×1.2=0.006M or more. The value of 1.2 is the lower limit mole ratio of [TEA]/[$Cu^{2+}$] as seen in FIG. 1. Desirably, the deposition rate is 0.01M or more and the TEA is then in an amount of 0.01M×1.2=0.012M or more. The upper limit of the copper concentration should be determined while considering the economy and stability of the bath, but the bath was completely stable at up to 0.07M of [$Cu^{2+}$]. At 0.08M, with some pH, deposition was sometimes seen on the bottom of the beaker. Here, the absolute amount of TEA is $0.08M \times 30 = 2.4M$ from the upper limit of the mole ratio of $[TEA]/[Cu^{2+}]$ of 30.

(7) Change of deposition rate by concentration of formalin in TEA bath

FIG. 8 shows changes of the deposition rate when the amount of the formalin, i.e., the reducing agent, was altered and $[TEA]/[Cu^{2+}]=r$ was kept at 3 and 5. The deposition rate also depends considerably on the concentration of formalin, as it does on the concentration of copper.

Therefore, the deposition rate can be optionally controlled by the concentrations of the copper and the formalin.

The preferably used reducing agents are formalin or derivatives or precursors thereof. If a molecule of a reducing agent has one portion of a formaldehyde unit to be oxidized, the mole concentration of the reducing agent should be 0.05M or more, preferably 0.06 or more, from FIG. 8. The upper limit of the amount of the reducing agent, although it should be determined by the economy and stability of the bath, is, for example, 0.3M. If the 0.05M to 0.3M of formalin is converted to an aqueous formalin, it becomes 4 ml/l to 25 ml/l, in which range no problem arose with the stability of the bath.

(8) Combined use of other reducing agents

From the viewpoin of the stability of the bath, the economy, and practical utility, the formaldehyde series is preferably as the reducing agent. However, formalin may be detrimental to the human body and cause instability of the bath when used in a large amount, and thus as little as possible should be used. For example, it is better if the amount of formalin is reduced and other reducing agents are jointly used, and the deposition rate is still increased. From this consideration, sodium hypophosphite, which is a most generallt used reducing agent, was used in combination with formalin and tests were conducted. Sodium hypophosphite has no reducing activity on the surface of copper, and thus was not been used in electroless copper plating except as an activator in Japanese Unexamined Patent Publication (Kokai) No. 55-76054.

In baths according to the present invention, sodium hypophosphite alone does not cause a reaction, but appears as a reducing agent if formaldehyde coexists. See FIGS. 9 and 10. The experiments were conducted in the following TEA and EDTA baths added with formalin alone and with a combination of formalin and 0.1M of sodium hypophosphite, with a change of the concentration of formalin.

| | |
|---|---|
| TEA bath: | |
| $CuCl_2$ | 0.06 M |
| TEA | 0.3 M (r = 5) |
| Potassium ferrocyanide | 20 mg/l |
| 2,2'-bipyridyl | 10 mg/l |
| pH at 25° C. | 12.8 |
| Bath temperature | 60° C. |
| EDTA bath: | |
| $CuCl_2$ | 0.06 M |
| EDTA | 0.09 M |
| pH at 25° C. | 12.6 |
| Bath temperature | 50° C. |

Figure 10:
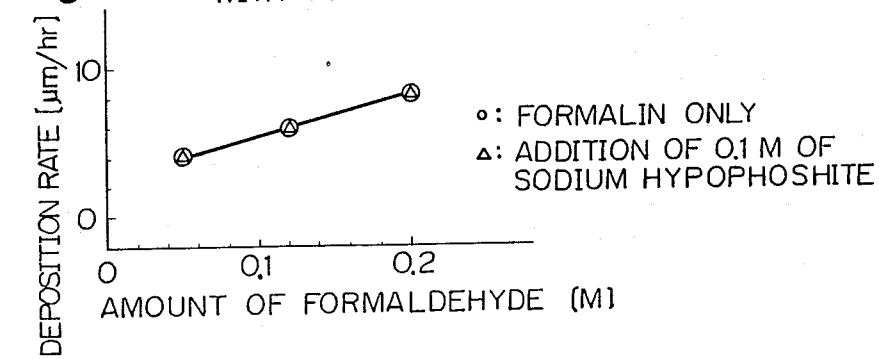

Referring to FIGS. 9 and 11, sodium hypophosphite has no effect in EDTA baths but seems to act as a reducing agent in TEA baths. This effect may be taken as a catalyst action of a formalin reaction, as mentioned in Japanese Unexamined Publication (Kokai) No. 55-76054, but may be also considered as sodium hypophosphite reacted with some reaction intermediate. From FIG. 9, it is certain that sodium hypophosphite, although it does not act alone, effectively accelerates the plating reaction if used in combination with formalin.

(9) Change of deposition rate by $O_2$ concentration

As mentioned before, aeration is very important in a plating bath of the present invention. FIG. 11 shows changes of the deposition rate when the $O_2$ concentration was at two levels. The $O_2$ concentration of 0.3 ppm was obtained when $N_2$ was bubbled in a 500 cc bath for 10 minutes, and the $O_2$ concentration of 2.3 ppm was obtained when air was bubbled in a similar manner. From FIG. 11, it is seen that the $O_2$ concentration had a large effect on the deposition rate in a TEA bath.

If the $O_2$ concentration is reduced below 0.3 ppm, the bath becomes unstable. A higher $O_2$ concentration does not cause a problem but $O_2$ bubbling is not economical and normal air bubbling is sufficient. The preferable $O_2$ concentration range is 0.5 ppm at least and no problem occurs up to 5.4 ppm, a saturated $O_2$ concentration. The practically suitable range is preferably from 1.5 to 4 ppm.

(10) Effect of triethanolamine when other complexing agents are used

The above effects of the present invention are considered to be synergistic effects of the complexing effect and the accelerating effect of the trialkanolmonoamine. Therefore, to determine the accelerating effect of a trialkanolmonoamine with other complexing agents, a change of the deposition rate was examined by adding TEA into a bath containing EDTA as a complexing agent for copper ion. The results are shown in FIG. 12. The bath without TEA was an EDTA only bath and had a deposition rate of 1 to 2 μm/hr only. With an addition of TEA at 0.01 to 0.2M, a $TEA-Cu^{2+}$ complex is not considered to be formed and the little acceleration seen was considered to be the same as the effect of trialkylamine disclosed separately. At an addition of TEA of 0.15M or more, deposition rates of 10 μm/hr or more were seen, and these are considered due to the formation of a small amount of a $TEA=Cu^{2+}$ complex by a reaction of $EDTA-Cu^{2+}+TEA \rightleftarrows TEA-Cu^{2+}+EDTA$. From this, it may be considered that, even if another complexing agent is used, acceleration may be made to appear by an addition of trialkanolmonoamine in an amount of more than twice the mole of the other complexing agent.

From the above, it is clear that acceleration by a trialkanolmonoamine is completely different from acceleration by a trialkylamine, and is obtained after a formation of a complex of a trialkanolmonoamine with copper ion. Further, it should be noted that this acceleration is obtainable only when a trialkanolmonoamine acts as an accelerator to a complex of a trialkanolmonoamine with copper ion. Accordingly it is necessary for this acceleration that a complex of a trialkanolmonoamine and copper ion be present. It is further necessary that trialkanolmonoamine other than that forming the complex is copresent. Such a complex is formed even when another complexing agent is used, if the trialkanolmonoamine is used in an amount of more than twice the amount of the complexing agent used, and causes acceleration.

(11) Effects by kinds of copper salts

In all of the above experiments, copper (II) chloride $CuCl_2$, which is easily solved, was used. FIG. 13 shows the results of the deposition rate when other copper salts, copper sulfate $CuSO_4$ and copper nitrate $Cu(NO_3)_2$, which are conventionally used, were used. The basic bath contained 0.06M of a copper salt and 0.18M (r=3) of TEA. It is seen that acceleration does not depend on the kind of copper salts and is substantially constant.

(12) Effect by temperature

FIG. 14 shows the change of the deposition rate in a typical fast TEA bath (r=3, pH 12.8), under the same conditions, when the temperature was altered. From FIG. 14, 60° C. is considered to be the most preferable temperature, but it is seen that even at 30° C., for example, a faster deposition rate than that of a conventional bath is obtained (less than 1 μm/hr when the same additives are added). Accordingly, with the bath of the present invention, it is easy to obtain an accelerated electroless copper plating reaction at a normal temperature, in some applications. If the temperature is over 80° C., the side reactions become very active and the bath may be decomposed or become clouded. Accordingly, usually the highest temperature is desirably 80° C.

Accordingly, the preferable temperature range is from the normal temperature up to 80° C., as shown in FIG. 14. Here, the normal temperature is a temperature of a range of from 0° C. to 30° C., more preferably from the normal temperature to 70° C. However, the temperature is determined by the applications or usages of the plating. At any temperature, however, the deposition rate in the bath of the present invention is more than ten times that of a conventional bath.

(13) Properties of deposited layer

Potassium ferrocyanide and 2,2'-bipyridyl as typical properties improving agents; polyethylenegrycol (neutrious surfactant, molecular weights of 20,000 and 2,000) usually used; and anionic surfactants, were added to a basic bath containing 0.3M (r=5) of TEA with pH 12.7. In this bath, a copper plating layer having a thickness of about 30 μm was formed on a stainless steel plate 10 cm×5 cm, from which strips 1 cm in width were cut to be used in a tensile text. As a measure of the properties of the layer, the elongation thereof was determined. The results are shown in Table 4. In all cases, the bath was not controlled and the plate was immersed in a 10 l bath for 30 to 40 minutes to form a deposited layer. The values of a 30 to 50 μm/hr deposition rate and a 1.5 to 8%, particularly, 5 to 8% elongation demonstrate a superior layer in a short time. A further improvement of properties of a plating layer with a fast deposition rate can be also attained by controlling the bath or improving the additives.

TABLE 4

| Additive | Properties of Deposited Layer Sample No. 1 | 2 | 3 | 4 | 5 | 6 |
|---|---|---|---|---|---|---|
| Potassium ferrocyanide: 30 mg/l | o | o | o | o | — | — |
| 2,2-bipyridyl: | o | o | o | o | — | — |

TABLE 4-continued

| Additive | Properties of Deposited Layer Sample No. 1 | 2 | 3 | 4 | 5 | 6 |
|---|---|---|---|---|---|---|
| 20 mg/l | | | | | | |
| Polyethylenegrycol (MW = 2000): 2 g/l | o | — | — | — | — | — |
| Polyethylenegrycol (MW = 20000): 2 g/l | — | o | — | — | — | — |
| Fc-95*: 0.2 g/l | — | — | o | — | o | — |
| Fc-98*: 0.2 g/l | — | — | — | o | — | o |
| Deposition rate: μm/Hr | 50 | 45 | 30 | 35 | 40 | 45 |
| Elongation: % | 1.5 | 2.1 | 6.5 | 7.8 | 5.2 | 4.9 |

Note
Fc-95 and Fc-98 are anionic surfactants (alkylsulphonate) sold by 3M.

For reference, the chemical formulae of typical trialkanolmonoamines and other complexing agents are shown in FIGS. 15 and 16, respectively.

From the above series of experiments, it is clear that a fast electroless copper plating reaction heretofore thought impossible, is obtained by using a trialkanolmonoamine as a complexing agent for copper ion, in an amount of more than 1.2 times the mole concentration of the copper ion, thus making it act as an accelerator.

Finally, typical results of the deposition by the present invention and by the prior art are shown in Table 5. Is is clear that a fast electroless copper plating reaction having a deposition rate of about 40 times the deposition rate of the prior art, is obtained by triisopropanolamine and about 100 times that of the prior art is obtained by trietanolamine.

TABLE 5

| Complexing agent | Concentration | Deposition rate |
|---|---|---|
| Invention: | | |
| Triethanolamine | 0.18 M | 110 μm/hr |
| Triisopropanolamine | 0.09 M | 50 μm/hr |
| Comparative: | | |
| EDTA | 0.08 M | 1.2 μm/hr |
| Bath: | | |
| Copper salt: | $CuCl_2$ | 0.06 M |
| Reducing agent: | formalin | 18 ml/l |
| pH: | 12.8 at 25° C. | |
| Temperature: | 60° C. | |
| Additives: | | |
| Potassium ferrocyanide | 20 mg/l | |
| 2,2'-bipyridyl | 10 mg/l | |

We claim:

1. An electroless copper plating solution comprising a copper salt, a reducing agent, a pH-adjustor and trialanolmonoamine or a salt thereof in an excess amount such that it acts as a complexing agent for copper ion and as an accelerator, said trialkanolmonoamine or a salt thereof being present in an amount such that a copper deposition rate is substantially increased in comparison with a copper deposition rate obtained when the trialkanolmonoamine or a salt thereof is present in an amount sufficient to completely complex the copper ion but not enough to act as an accelerator.

2. A solution according to claim 1, wherein said trialkanolmonoamine is triethanolamine and is present in an amount of 1.2 to 30 times the mole concentration of the copper ion.

3. A solution according to claim 2, wherein said triethanolamine is present in an amount of 1.3 to 20 times the mole concentration of the copper ion.

4. A solution according to claim 3, wherein said triethanolamine is present in an amount of 1.5 to 20 times the mole concentration of the copper ion.

5. A solution according to claim 1, further containing an additive for improving properties of a deposited layer.

6. A solution according to claim 5, wherein said additive is selected from a group consisting of potassium ferrocyanide, 2,2-dipyridyl, polyetyleneglycol, an anionic surfactant and a mixture thereof.

7. A solution according to claim 6, wherein said anionic surfactant is an alkylsulphonate.

8. A solution according to claim 1, wherein said trialkanolmonoamine is triisopropanolamine and is present in an amount of 1.2 to 30 times the mole concentration of the copper ion.

9. A solution according to claim 8, wherein said triisopropanolamine is present in an amount of 1.2 to 10 times the mole concentration of the copper ion.

10. A solution according to claim 9, wherein said triisopropanolamine is present in an amount of 1.2 to 5 times the mole concentration of the copper ion.

11. A solution according to claim 1, having a pH of 12.0 to 13.4, a temperature of 0° C. to 80° C., and a oxygen concentration of 0.5 to 5.4 ppm.

12. A solution according to claim 11, having a pH from 12.4 to 13.0, and a temperature from 0° C. to 70° C., said oxygen concentration being from 1.5 to 4.0 ppm.

* * * * *